US008495793B2

(12) United States Patent
Cayer

(10) Patent No.: US 8,495,793 B2
(45) Date of Patent: Jul. 30, 2013

(54) QUICK RELEASE DOOR HINGE SYSTEM

(76) Inventor: Yolain Cayer, Longueuil (CA)

( * ) Notice: Subject to any disclaimer, the term of this patent is extended or adjusted under 35 U.S.C. 154(b) by 44 days.

(21) Appl. No.: 13/233,962

(22) Filed: Sep. 15, 2011

(65) Prior Publication Data

US 2012/0066863 A1 Mar. 22, 2012

(30) Foreign Application Priority Data

Sep. 16, 2010 (GB) ..... 1015523.2

(51) Int. Cl.
*E05D 7/10* (2006.01)

(52) U.S. Cl.
USPC ..... 16/265; 16/262

(58) Field of Classification Search
USPC ..... 16/262, 265, 268, 260, 270, 271, 16/386, 387, DIG. 23
See application file for complete search history.

(56) References Cited

U.S. PATENT DOCUMENTS

| | | | | |
|---|---|---|---|---|
| 1,091,609 | A * | 3/1914 | Welch | 16/265 |
| 2,677,147 | A | 5/1954 | Phillips | |
| 2,748,420 | A | 6/1956 | Clover | |
| 3,869,752 | A * | 3/1975 | Klay | 16/234 |
| 4,381,580 | A | 5/1983 | Hellstrom et al. | |
| 4,424,607 | A * | 1/1984 | Langenhorst | 16/387 |
| 4,869,143 | A * | 9/1989 | Merrick et al. | 83/467.1 |
| 5,127,132 | A * | 7/1992 | Karlin | 16/261 |
| 5,490,440 | A * | 2/1996 | Karlis et al. | 83/599 |
| 5,706,556 | A * | 1/1998 | Kluting | 16/273 |
| 5,956,809 | A * | 9/1999 | Hodgson | 16/224 |
| 6,151,757 | A * | 11/2000 | Beals et al. | 16/380 |
| 6,397,432 | B1 | 6/2002 | di Vinadio | |
| 7,603,746 | B1 | 10/2009 | Resch et al. | |
| 7,703,364 | B2 * | 4/2010 | Jaksha | 83/467.1 |
| 2007/0143961 | A1 * | 6/2007 | Weber | 16/265 |

FOREIGN PATENT DOCUMENTS

| | | |
|---|---|---|
| EP | 0704594 | 3/1996 |
| GB | 720959 | 12/1954 |
| JP | 2009281101 A * | 12/2009 |

* cited by examiner

*Primary Examiner* — Chuck Mah

(57) ABSTRACT

A quick release door hinge system has a locking pin and two flaps: A jamb flap that is fixedly attached to a door jamb and a door flap which is fixedly attached to a door. The door flap has built-in downwardly pointing pins that are configured and sized to fit into channels found on the jamb flap. Once the two flaps are connected, the locking pin is inserted so as to block any upward motion of the door flap which could result in an inadvertent release of the door from its hinges.

3 Claims, 5 Drawing Sheets

FIG. 3a
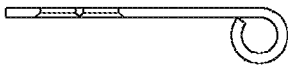
FIG. 3b
FIG. 3c
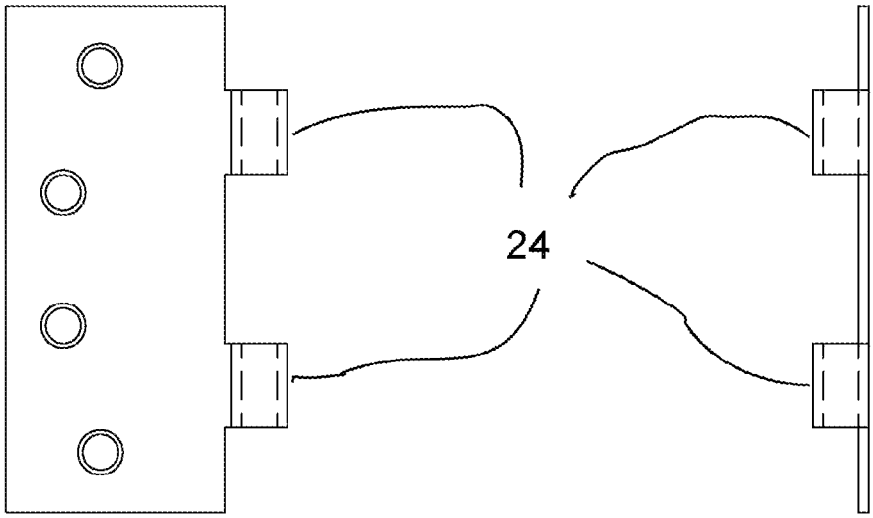

QUICK RELEASE DOOR HINGE SYSTEM

This application claims priority based on request GB1015523.2 filed Sep. 16, 2010

FIELD OF THE INVENTION

The present invention relates generally to hinges but more particularly to a quick release door hinge system.

BACKGROUND OF THE INVENTION

Door hinges have been around for centuries. They consist of two plates joined by way of a pin. The pin has to be removed in order for the two plates to be separated and thus allow the removal of the door. Removing the pin often requires hand tools and takes time to accomplish. During installation, aligning the two parts can sometimes be challenging on a heavy door having three sets of hinges as all three sets have to be aligned before a single pin can be inserted.

SUMMARY OF THE INVENTION

In view of the foregoing disadvantages inherent in the known devices now present in the prior art, the present invention, which will be described subsequently in greater detail, is to provide objects and advantages which are:

To provide for a door hinge system that accelerates the installation of a door on its hinges.

Another advantage of this invention is to provide for a means to eliminate tampering which could lead to unwanted release from the hinges.

To attain these ends, the present invention generally comprises a jamb flap adapted to be fixedly attached to a door jamb, and including at least two channel members adapted to receive door flap pin members therein; a door flap adapted to be fixedly attached to a door, and including at least two pin members adapted to be received within respective channel members of the jamb flap, such that when the door flap pin members are placed within respective jamb flap channel members the two flap members are pivotable to one another; and a locking pin member adapted to be placed between two of the at least two channel members to thereby block the removal of the door flap pin members from the jamb flap channel members, and thereby prevent the disconnection between the door flap and the jamb flap. Barrels centrally located on a vertical axis and bevels of screw holes located on both faces of the jamb flap and door flap to allow for jamb flap and door flap to be used on left and right side.

The locations of the jamb flap and the door flap are adapted to be reversible.

The jamb flap and the door flap are made from a metallic material; and the locking pin member is magnetic and adapted to magnetically attach between two of the at least two channel members when the door flap is pivotally connected with the jamb flap, to thereby stay in place yet be easily removable by hand.

The door hinge system has three jamb flap channel members and three door flap pin members.

A method of pivotally attaching a door member to a door jamb, the method comprising the steps of:

a.) Providing a door jamb.

b.) Providing a door.

c.) Providing at least two hinge systems, wherein each hinge system comprises a jamb flap adapted to be fixedly attached to the door jamb, and including at least two channel members adapted to receive door flap pin members therein. A door flap adapted to be fixedly attached to the door, and including at least two pin members adapted to be received within respective channel members of the jamb flap, such that when the door flap pin members are placed within respective jamb flap channel members the two flap members are pivotable to one another. And a locking pin member adapted to be placed between two of the at least two channel members to thereby block the removal of the door flap pin members from the jamb flap channel members, and thereby prevent the disconnection between the door flap and the jamb flap.

d.) Connecting the jamb flaps to the door jamb.

e.) Connecting the door flaps to the door such that each door flap is in proper alignment with each respective jamb flap.

f.) Raising and moving the door into alignment with the door jamb, such that the door flap pin members are in alignment with the jamb flap channel members.

g.) Lowering the door, such that the each respective door flap pin member slides into each respective jamb flap channel member.

h.) Placing a locking pin member in between the at least two channel members of each hinge system, to thereby block the removal of the door flap pin members from the jamb flap channel members, prevent the disconnection between the door flap and the jamb flap; and thereby prevent the disconnection between the door and the door jamb.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIGS. 3*a-c* Top, side, and front views, respectively, of the jamb flap.

DETAILED DESCRIPTION OF THE PREFERRED EMBODIMENT

Figures 4A, 4B:
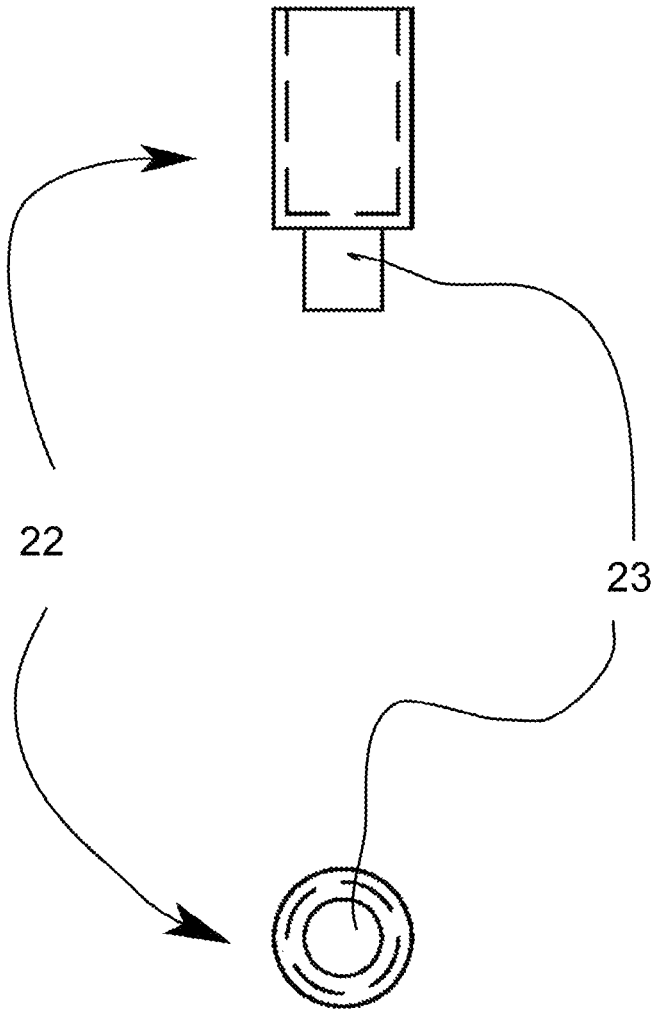
FIGS. 4*a-b* Side and bottom views, respectively, of the pin.
Figures 5A, 5B:
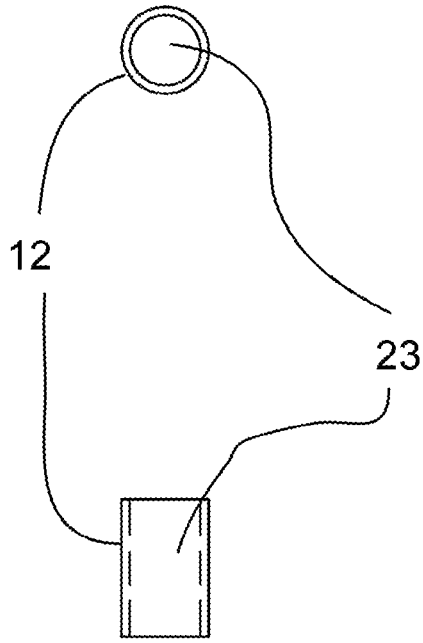
FIGS. 5*a-b* Side and bottom views, respectively, of the locking pin.

A quick release door hinge system (10) has a locking pin (12) and two flaps (14, 16). A jamb flap (14) that is fixedly attached to a door jamb (18) and a door flap (16) which is fixedly attached to a door (20). The door flap (16) has built-in downwardly pointing pins (22) that are configured and sized to fit into channels (24) found on the jamb flap (14). Once the two flaps (14, 16) are connected, the locking pin (12) is configured and sized to be frictionally inserted between the pins (22) and the channels (24) so as to block any upward motion of the door flap (16) which could not only result in an inadvertent release of the door (20) from its quick release door hinge system (10) but most importantly, prevents potential removal of the door (20) by robbers or any such unwanted removal from the quick release door hinge system (10). To further improve the frictional insertion, the locking pin (12) can be magnetized to better cling to the ferrous hinge system (10). Better yet, the pins (22), as seen in FIGS. 4*a-b*, can have a magnetic core (23) presenting opposing polarities so as to increase the strength of the connection between the pins (22) and the locking pin (12).

It should be noted that the location of the flaps (14, 16) can be reversed, that is, the jamb flap (14) can be installed on the door (20) and vice versa. This configuration can help in the lubrication of the hinge (10). Also, the locking pin is preferably a magnet so that it can more easily stay in place.

Figure 1:
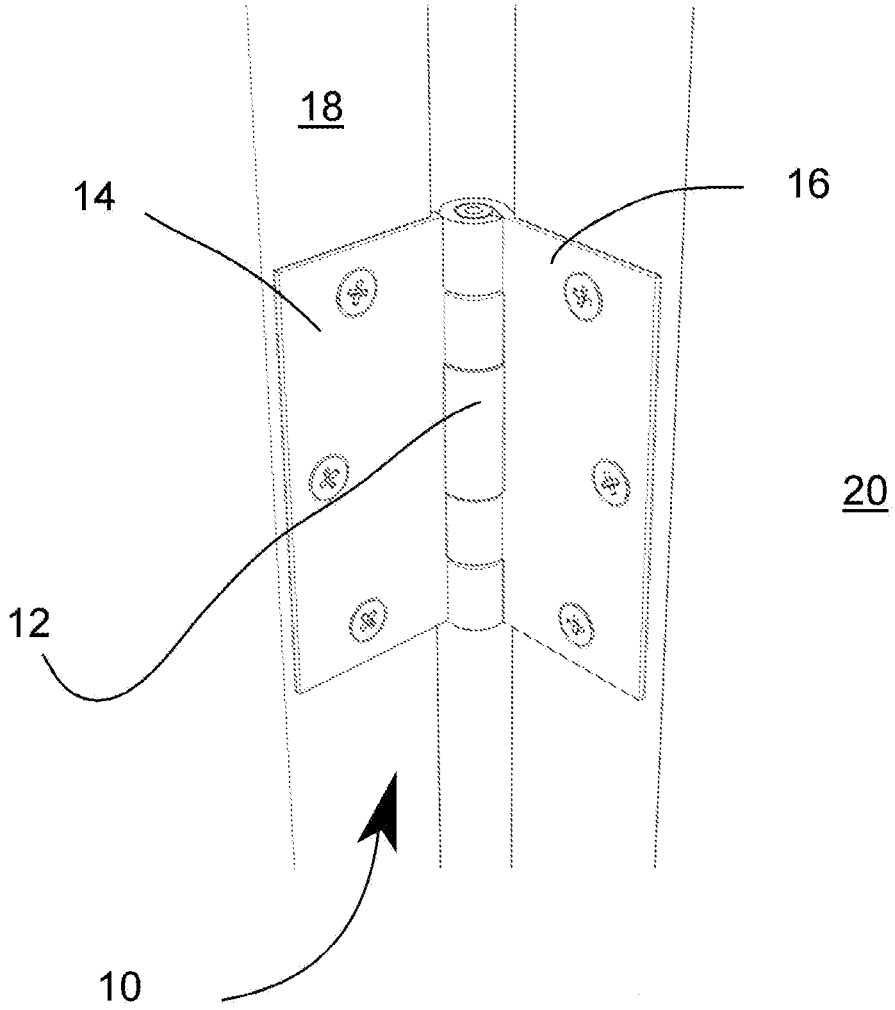
FIG. 1 Isometric view of the invention in context.
Figures 2A, 2B, 2C:
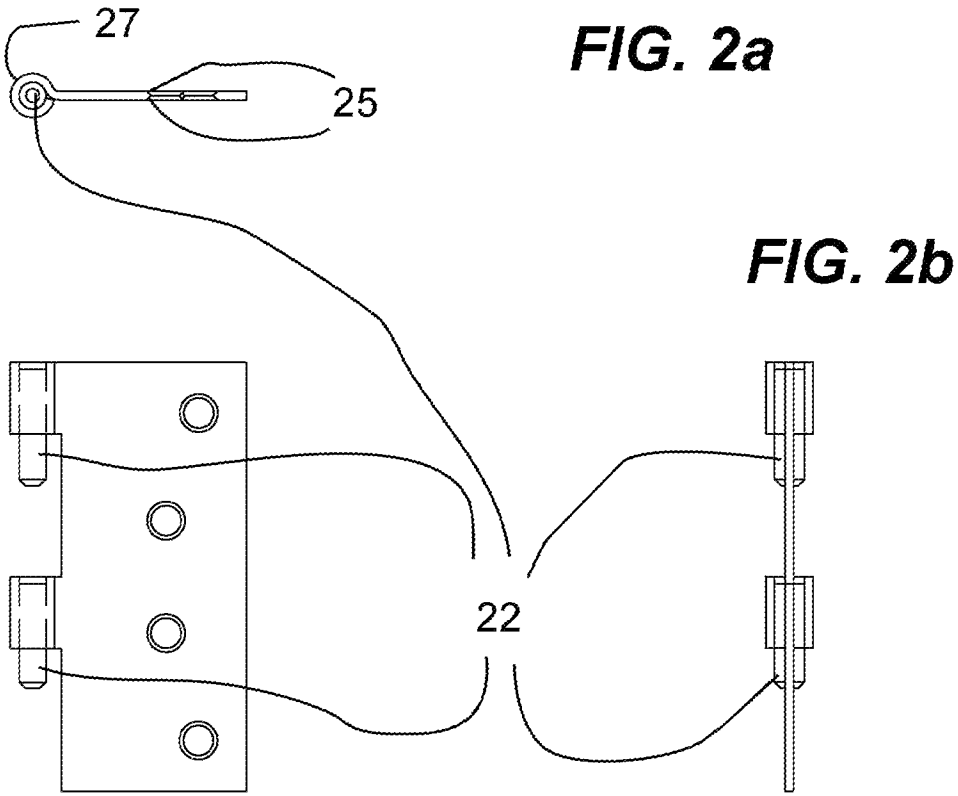
FIGS. 2*a-c* Top, side, and front views, respectively, of the door flap.

Moreover, because of symmetry in construction, more specifically the way the barrels (27) are centrally located on the vertical axis, as seen in FIGS. 2*a* and 3*a*, they can be placed on the left or the right of a door. Also, screw holes (29) have a bevel (25) located on both sides so that both faces of the jamb flap (14) can be used equally well. The door flap (16) also has the same barrel (27) and bevel (25) configuration for use on the left hand side as well as the right hand side.

In order to release the door (20), a user simply removes the locking pin (12) by pushing it with a finger; opens the door (20) and; lifts the door (20) so that the downwardly pointing pins (22) are released from the channels (24). Reversing the steps allows for quick re-installation of the door (20).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A quick-release door hinge system comprising:

a planar jamb flap adapted to be fixedly attached to a door jamb, and including at least two channel members, said channel members being vertically aligned and spaced apart;

a planar door flap adapted to be fixedly attached to a door, and including at least two pin members pivotally received within respective channel members of said jamb flap, said pin members being vertically aligned and spaced apart, wherein each of said pin members comprises an upper barrel section and a lower pin section extending downwardly from said barrel section, such that said pin sections are insertable into and removable from said respective channel members;

a locking pin member configured and sized to be removably placed in a space between one of said channel members and one of said barrel sections to thereby block the removal of said pin members from said jamb flap channel members, and thereby prevent the disconnection between said door flap and said jamb flap;

wherein the pin members are centrally aligned with the plane of the door flap, the channel members are centrally aligned with the plane of the jamb flap, and said jamb flap and said door flab include screw holes having bevels located on both faces of said jamb flap and said door flap to allow said jamb flap and said door flap to be used on left side or right side of the door and to allow the locations of said jamb flap and said door flap to be reversible; and wherein said jamb flap and said door flap are made from a metallic material; and said locking pin member is magnetic and adapted to be magnetically attached in the space between one of the channel members and one of the barrel sections when said door flap is pivotally connected with said jamb flap, to thereby stay in place yet be easily removable by hand.

2. The quick-release door hinge system of claim 1, wherein said jamb flap has three channel members and said door flap has three pin members.

3. The quick-release door hinge system of claim 1, wherein said pin members have a magnetic core.

* * * * *